US009365372B2

(12) United States Patent
Woo

(10) Patent No.: US 9,365,372 B2
(45) Date of Patent: Jun. 14, 2016

(54) PRINTING MEDIUM SUPPLYING APPARATUS AND IMAGE FORMING APPARATUS HAVING THE SAME

(71) Applicant: Samsung Electronics Co., Ltd., Suwon-si (KR)

(72) Inventor: Ji Hoon Woo, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/476,095

(22) Filed: Sep. 3, 2014

(65) Prior Publication Data

US 2015/0061214 A1 Mar. 5, 2015

(30) Foreign Application Priority Data

Sep. 3, 2013 (KR) ..... 10-2013-0105672

(51) Int. Cl.
*B65H 1/04* (2006.01)
*B65H 3/06* (2006.01)

(52) U.S. Cl.
CPC ..... *B65H 1/04* (2013.01); *B65H 3/0607* (2013.01); *B65H 2402/64* (2013.01); *B65H 2403/5331* (2013.01); *B65H 2405/1117* (2013.01); *B65H 2405/324* (2013.01); *B65H 2601/322* (2013.01); *B65H 2801/06* (2013.01)

(58) Field of Classification Search
CPC .... B65H 1/04; B65H 3/0661; B65H 2402/31; B65H 2405/11162; B65H 2405/1117; B65H 2405/324; B65H 3/0607; B65H 2403/5331; B65H 2402/64; B65H 2601/322; B65H 2801/06
USPC ..... 271/127, 162
See application file for complete search history.

(56) References Cited

U.S. PATENT DOCUMENTS

| | | | | |
|---|---|---|---|---|
| 2009/0267283 | A1* | 10/2009 | Mizuguchi | 271/3.14 |
| 2011/0227277 | A1* | 9/2011 | Wada et al. | 271/162 |
| 2013/0106043 | A1* | 5/2013 | Murakami | 271/9.01 |
| 2013/0164064 | A1* | 6/2013 | Matsumoto | 399/361 |

* cited by examiner

*Primary Examiner* — David H Bollinger
(74) *Attorney, Agent, or Firm* — Staas & Halsey LLP

(57) ABSTRACT

A printing medium supplying apparatus may include a body, a feed tray configured to rotate between a first position in which the feed tray forms an external appearance of the body and a second position in which a printing medium is loaded, a knock-up plate provided on the feed tray configured to ascend and descend, a pickup roller configured to make contact with the loaded printing medium as the knock-up plate ascends, and a rotating lever configured to allow the knock-up plate to be restricted at a side of the feed tray when the feed tray rotates from the first position to the second position. Accordingly, the knock-up plate are restricted and released together with operations of the pickup roller and the feed tray.

20 Claims, 8 Drawing Sheets

PRINTING MEDIUM SUPPLYING APPARATUS AND IMAGE FORMING APPARATUS HAVING THE SAME

CROSS-REFERENCE TO RELATED APPLICATIONS

This application claims the priority benefit of Korean Patent Application No. 10-2013-0105672, filed on Sep. 3, 2013, in the Korean Intellectual Property Office, the disclosure of which is incorporated herein by reference.

BACKGROUND

1. Field

Embodiments of the present disclosure relate to a printing medium supplying apparatus and an image forming apparatus having the same, and more particularly, to a printing medium supplying apparatus having an improved structure for facilitating supply of printing medium and an image forming apparatus having the same.

2. Description of the Related Art

An image forming apparatus is designed to form an image on a printing medium according to an input signal. Examples of the image forming apparatus include a printer, a copier, a facsimile and a multi-function device combining functions of the above-mentioned appliances.

The image forming apparatus is provided with a printing medium supplying apparatus for supplying printing medium. In general, the printing medium supplying apparatus picks up stacked printing media one by one and supplies the printing medium to a body of the image forming apparatus.

The printing medium supplying apparatus includes a feed tray configured to store a plurality of sheets of printing media that are to be fed to an image forming part, and a knock-up plate is provided on the feed tray so as to move up and down.

The knock-up plate is provided to allow the printing medium to be pressed against the pickup roller. As to install the knock-up plate, a user needs to forcedly and directly move the knock-up plate downward and keep pressing the knock-up plate in order to newly load printing medium on the feed tray, which causes inconvenience to a user.

SUMMARY

According to an aspect of one or more embodiments, there is provided a printing medium supplying apparatus having an improved structure for facilitating manipulation of a knock-up plate, and an image forming apparatus having the same.

According to an aspect of one or more embodiments, there is provided an image forming apparatus which may include a body, a feed tray, a knock-up plate, and a rotating lever. The feed tray may be configured to rotate between a first position in which the feed tray forms an external appearance of the body and a second position in which a printing medium is loaded. The knock-up plate may be provided on the feed tray configured to ascend and descend. The pickup roller may be configured to make contact with the loaded printing medium as the knock-up plate ascends. The rotating lever may be configured to allow the knock-up plate to be restricted at a side of the feed tray when the feed tray rotates from the first position to the second position.

The rotating lever may release the restriction of the knock-up plate at the same time when the pickup roller picks up the printing medium.

The rotating lever may include a lever body provided so as to be rotatable; and a locking protrusion which protrudes from the lever body to restrict the knock-up plate from ascending.

The locking protrusion may include a restriction surface that is bent from the lever body to make contact with the knock plate to restrict an ascending side of the knock-up plate.

The locking protrusion may include a guide inclination surface that protrudes so as to be inclined with respect to a length direction extending from a rotating center of the lever body such that the knock-up plate is restricted by the restriction surface.

The knock-up plate may be provided on a downstream side in a feeding direction of the printing medium being fed by the feed tray.

The knock-up plate may include: a plate rotating part provided on an upstream side in a feeding direction of the printing medium and allowing the knock-up plate to be rotated; and a plate lifting part provided on a downstream side in a feeding direction of the printing medium and configured to ascend and descend.

The knock-up plate may further include a holding protrusion that protrudes from the plate lifting part so as to be restricted by the rotating lever.

The image forming apparatus may further include a lever elastic member configured to press the lever body toward the knock-up plate.

The rotating lever may further include a mounting protrusion to mount one end of the lever elastic member pressing the lever body thereon.

The rotating lever may further include a lever rotating part provided at an end portion of the lever body to rotate the lever body and configured to operate with rotation of the pickup roller.

The image forming apparatus may further include a shaft coupled to the pickup roller, wherein the lever rotating part may be provided with an elliptical hollow part allowing the shaft to pass therethrough.

The lever rotating part may include an inner surface forming an elliptical hollow part, and the rotating lever may be rotated by friction made between the inner surface of the lever rotating part and an outer surface of the shaft.

The hollow part may be provided in an elliptical shape such that the rotating lever moves in a direction perpendicular to a lengthwise direction of the shaft.

The shaft may include: a first section to which the pickup roller is coupled and which is passed by the printing medium, and second sections which are provided at both sides of the first section and on which the rotating lever is disposed.

The second sections may be provided with a plurality of protrusions formed along a circumference of the shaft to increase friction with the inner surface of the lever rotating part.

According to an aspect of one or more embodiments, there is provided a printing medium supplying apparatus which may include a feed tray, a pickup roller, a knock-up plate and a rotating lever. The feed tray may allow a printing medium to be loaded thereon. The pickup roller may be configured to pick up the loaded printing medium. The knock-up plate may be provided on the feed tray so as to ascend and descend to allow the printing medium to make contact with the pickup roller. The rotating lever may be configured to allow the knock-up plate to be restricted at a side of the feed tray, the rotating lever configured to release the restriction of the knock plate by being spaced apart from the knock-up plate when the pickup roller picks up the printing medium.

The rotating lever may include: a lever body provided in an elongated shape; a lever rotating part provided at an end portion of the lever body and configured to operate with rotation of the pickup roller such that the lever body is moved; and a locking protrusion which protrudes from the lever body to press the knock-up plate toward the feed tray.

The printing medium supplying apparatus may further include a lever elastic member configured to press the rotating lever toward the knock-up plate.

If a force applied to the rotating lever by the lever elastic member is a first pressing force F1 and a force applied to the rotating lever in linkage with rotation of the pickup roller is a second pressing force F2, and the second pressing force F2 may be greater than the first pressing force F1 when the pickup roller operates.

The knock-up plate may include a first state in which the knock plate descends to make contact with the feed tray, and a second state in which the knock-up plate ascends to be spaced apart from the feed tray, and the knock-up plate may operate from the first state to the second as the rotating lever is spaced apart from the knock-up plate due to rotation of the pickup roller As is apparent from the above, the printing medium supplying apparatus and the image forming apparatus having the same can facilitate supplying the printing medium and allow the knock-plate to be pressed toward the pickup roller upon supplying the printing medium by improving the elevation structure of the knock-up plate.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
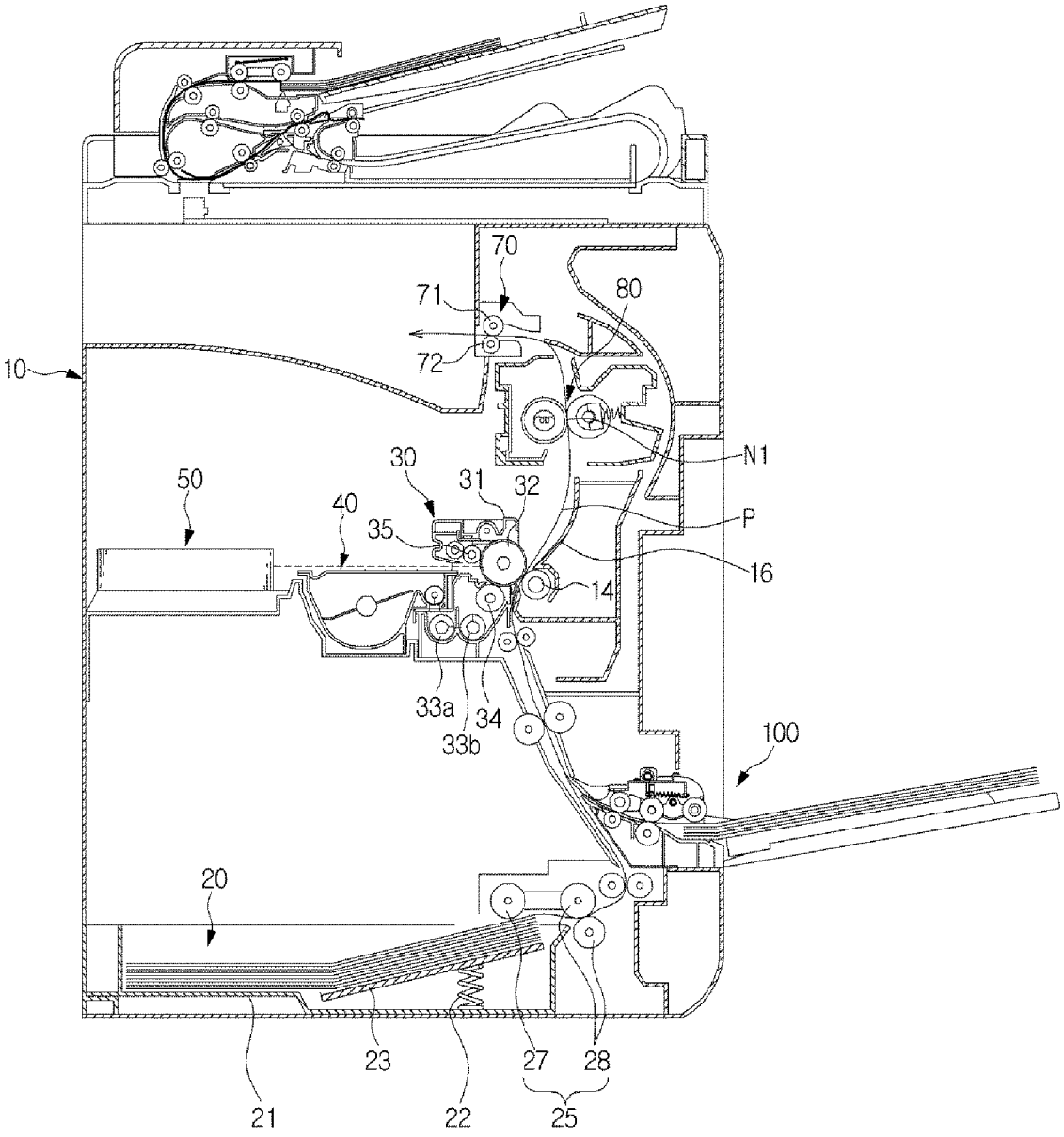
FIG. 1 is a view illustrating an image forming apparatus in accordance with an embodiment of the present disclosure.

Reference will now be made in detail to embodiments of the present disclosure, examples of which are illustrated in the accompanying drawings, wherein like reference numerals refer to like elements throughout.

FIG. 1 is a view illustrating an image forming apparatus in accordance with an embodiment of the present disclosure.

Referring to FIG. 1, an image forming apparatus 1 includes a body 10, printing medium supplying apparatuses 20 and 100 to store and feed printing media S, a developing device 30 to form an image on the printing medium S fed through the printing medium supplying apparatuses 20 and 100, a toner device 40 to feed toner to the developing device 30, an optical scanning device 50 to form an electrostatic latent image on a photosensitive body 32 of the developing device 30, a fusing device 80 to fix a tonner image transferred to the printing medium S to the printing media S, and a discharge device 70 to discharge the printing medium S having an image formed thereon to the outside of the body 10.

The printing medium supplying apparatus 20 serves store and feed the printing medium S and provided at a lower side of the body 10 to feed the printing medium S toward the developing device 30.

The printing medium supplying apparatus 20 includes a cassette-type feed part 21 retractably placed in the body 10 to store the printing medium S, and a transport member 25 to pick up the printing media S stored in the feed part 21 one by one and transport the same toward the developing device 30.

A knock-up plate 23 may be provided in the feed part 21. One end of the knock-up plate 23 is rotatably coupled, and the other end thereof is supported by a compression spring 22 to transport the stacked printing media S toward the transport member 25.

The transport member 25 includes a pickup roller 27 to pick up the printing medium S stacked on the knock-up plate 23 one by one, and a feed roller 28 to transport the printing medium S picked up by the pick-up roller 27 toward the developing device 30.

The developing device 30 includes a housing 31 forming an external appearance thereof, a photosensitive body 32 rotatably coupled to the inside of the housing 31 to form an electrostatic latent image, churning screws 33*a* and 33*b* to churn the toner fed from the toner device 40, a developing roller 34 to feed the toner churned by the churning screws 33*a* and 33*b* to the photosensitive body 32, and a charging member 35 to charge the photosensitive body 32.

The toner from the toner device 40 is introduced into the housing 31, churned by the churning screws 33*a* and 33*b* and transported to one side of the housing 31. The churned and transported toner is fed to the photosensitive body 32 by the developing roller 34 to form a visible image.

To transfer the visible image formed on the photosensitive body 32 by the toner to the printing medium S, the photosensitive body 32 contacts the transfer roller 14 and forms a transfer nip N1. The transfer roller 14 is rotatably disposed in the body 10.

The toner device 40 is coupled to the developing device 30 and adapted to accommodate and retain the toner to form an image on a printing media S and to feed the toner to the developing device 30 as image formation proceeds The optical scanning device 50 emits light including information about an image onto the photosensitive body 32 to form an electrostatic latent image on the photosensitive body 32.

The fusing device 80 applies heat and pressure to the printing medium S to fix the toner image formed on the printing medium S to the printing medium S. A detailed description of the structure of the fusing device 80 will be given later.

The discharge device 70 includes a first paper discharge roller 71 and a second paper discharge roller 72, which are sequentially installed, and discharge the printing medium S leaving the fusing device 100 to the outside of the body 10.

Disposed between the transfer nip N1 and the fusing device 80 is a guide rib 16 to guide the printing medium S leaving the transfer nip N1 to the fusing device 80. The guide rib 16 forms a portion of a transport path P of the printing medium S between the transfer nip N1 and the fusing device 80.

Figure 2:
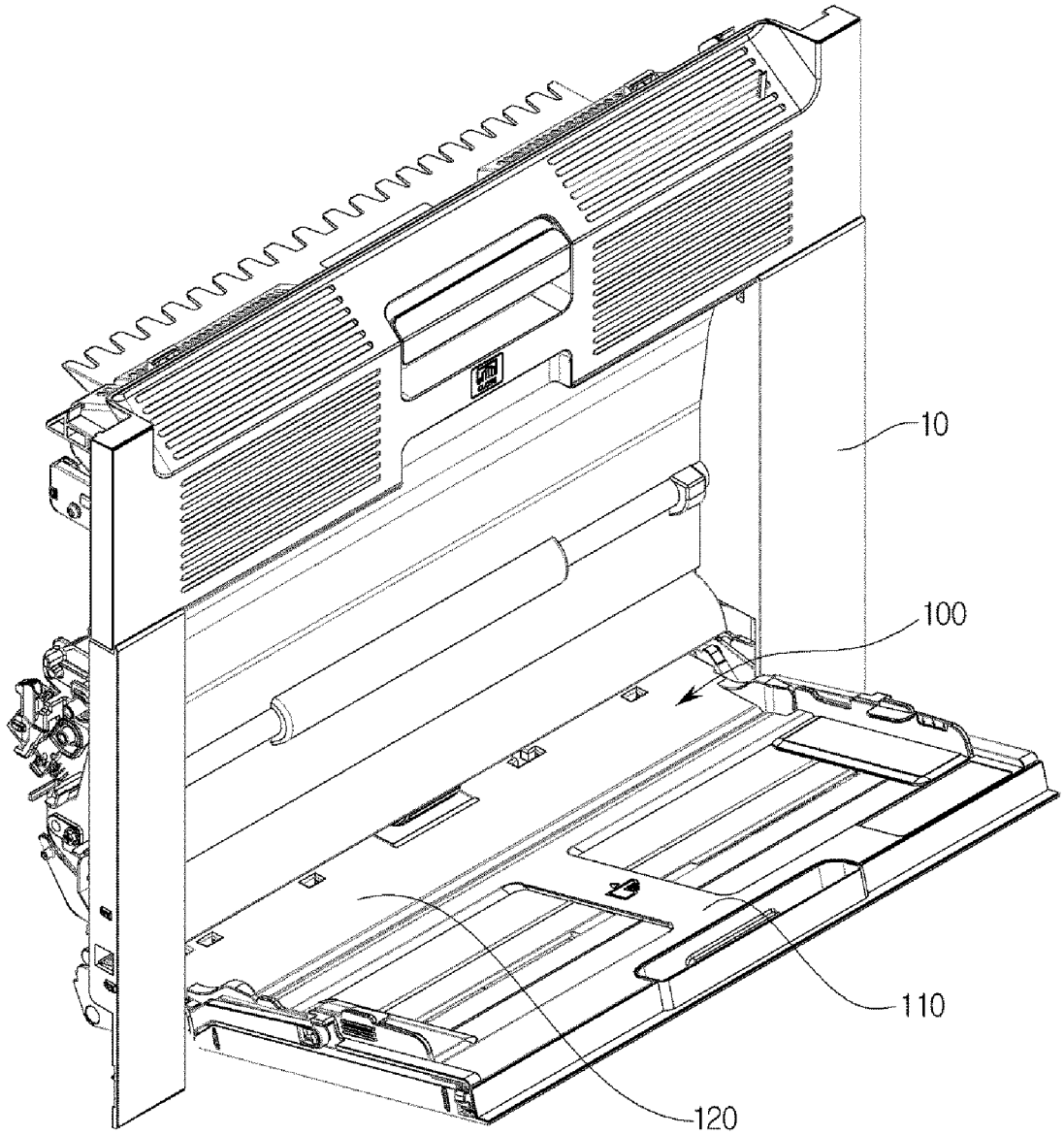
FIG. 2 is a view illustrating a feed tray of the image forming apparatus in accordance with an embodiment of the present disclosure which is open.
Figure 3:
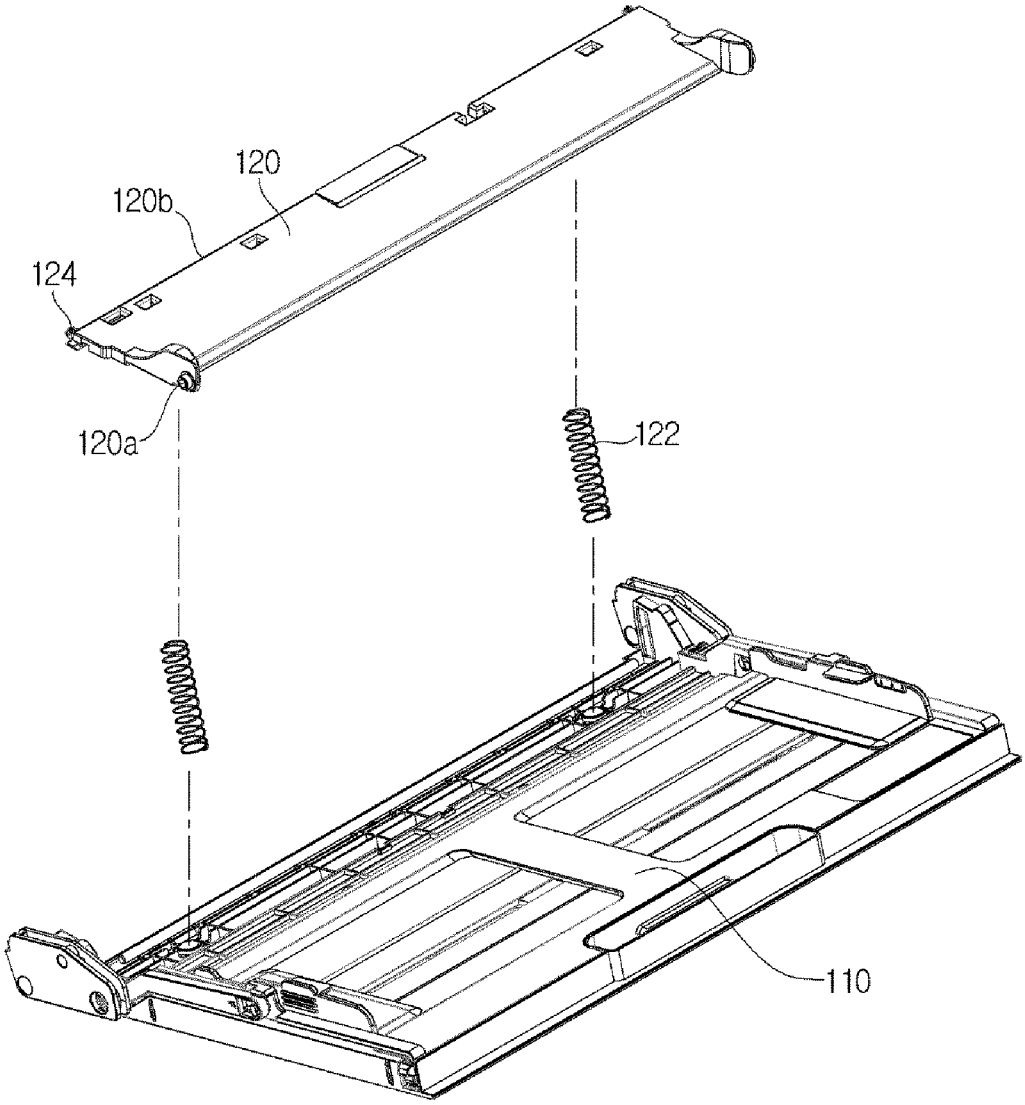
FIG. 3 is an exploded perspective view illustrating a feed tray and a knock-up tray in accordance with an embodiment of the present disclosure.
Figure 4:
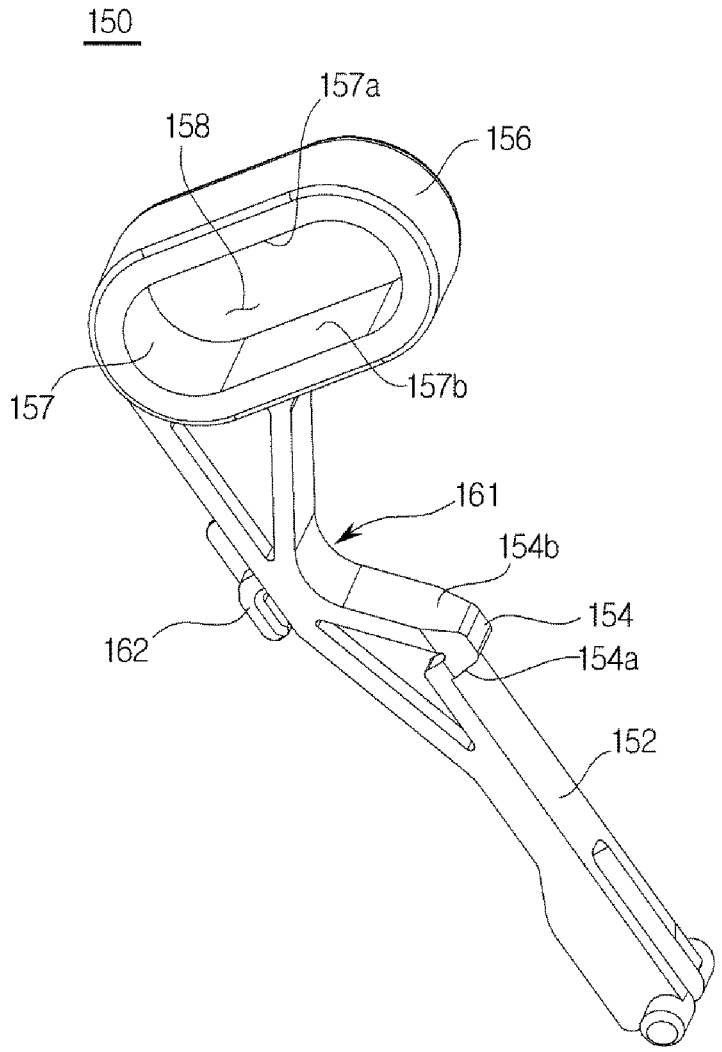
FIG. 4 is an exploded perspective view illustrating a pickup roller and a rotating lever in accordance with an embodiment of the present disclosure.
Figure 5:
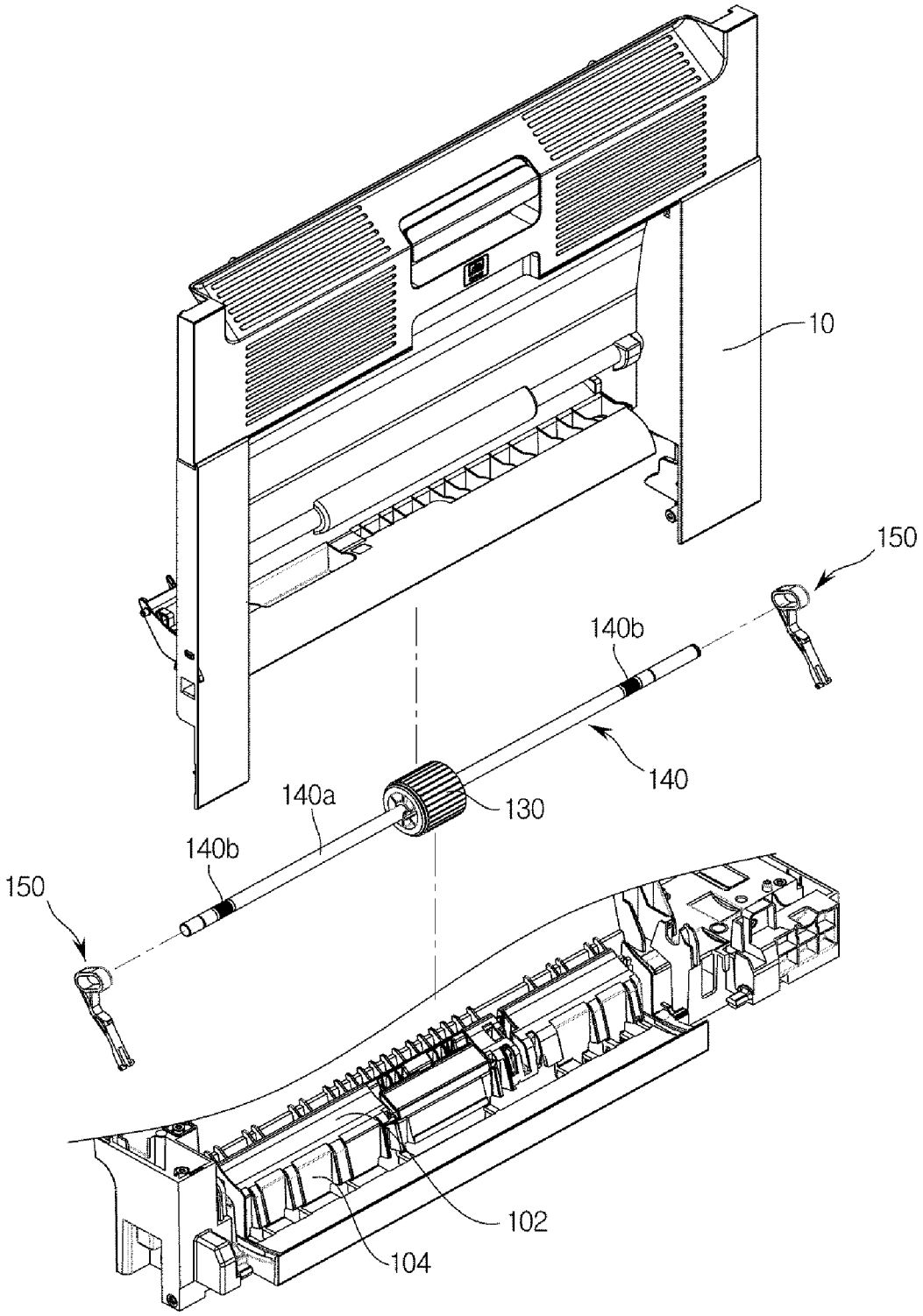
FIG. 5 is a perspective view illustrating a rotating lever in accordance with an embodiment of the present disclosure.

FIG. 2 is a view illustrating a feed tray in accordance with an embodiment of the present disclosure which is open, FIG. 3 is an exploded perspective view illustrating a feed tray and a knock-up tray in accordance with an embodiment of the present disclosure, FIG. 4 is an exploded perspective view illustrating a pickup roller and a rotating lever in accordance with an embodiment of the present disclosure, and FIG. 5 is a perspective view illustrating a rotating lever in accordance with an embodiment of the present disclosure.

Although the following description according to an embodiment of the present application will be made in relation to the printing medium supply apparatus 100 having a feed tray rotatable with respect to the body 10, the present disclosure is not limited thereto. For example, the present application may be applied to a printing medium supplying apparatus having a cassette-type feed tray 110 provided in the body 10.

The printing medium supplying apparatus 100 serves to supply printing medium to an element configured to form an image, for example, to the developing device 30 described above.

The printing medium supplying apparatus 100 may include a feed tray 110, a pickup roller 130, a knock-up plate 120 and a rotating lever 150.

The feed tray 110 is detachably provided on the body 10, and is rotatably provided to open and close the body 10.

In detail, the feed tray 110 is rotatable between a first position P1 in which the feed tray 110 is folded to one surface of the body 10 to form an external appearance of the body 10 and a second position P2 in which the feed tray 110 is open such that the printing medium S is loaded on the feed tray 110. A path W, allowing the printing medium S having been stacked on the feed tray 110 to be introduced into the body 10 by passing therethrough is provided to be closed when the feed tray 110 is at the first position P1, and open when the feed tray 110 is at the second position P2.

The pickup roller 130 is disposed on an upper portion of a front end in a feeding direction of printing medium S stacked on the feed tray 110. According to rotation of the pickup roller 130, the plurality of sheets of printing media S stacked on the feed tray 110 are picked up one by one starting from that the upper most printing medium S among the plurality of sheets of printing media S.

A printing medium guide surface 102 is provided on a lower side of the pickup roller 130 to guide and feed the printing medium S picked up by the pickup roller 130 to the image forming part inside the body 10. The printing medium S is guided by the printing medium guide surface 102, and by passing through a feed roller (not shown), is fed to the developing device 30.

The pickup roller 130 is coupled to a shaft 140 so as to be rotated together with rotation of the shaft 140. One end portion of the shaft 40 is coupled to a motor (not shown) and a plurality of gears (not shown) to receive a power, thereby rotating the pickup roller 130.

The shaft 140 includes a first section 140*a* to which the pickup roller 130 is coupled to the shaft 140 and is passed by the printing medium S, and second sections 140*b* provided at both sides of the first section 140*a* and on which the rotating lever 150 is disposed. The second sections 140*b* are disposed at both end sides of the knock-up plate 120, such that the rotating lever 150 restricts both end portions of the knock-up plate 120.

The second sections 140*b* may be provided with a plurality of protrusions formed along the circumference of the shaft 140 to increase friction with respect to a lever rotating part 156 of the rotating lever 150, which will be described later. The number and length of the second sections 140*b* are not limited thereto. According to an embodiment of the present disclosure, a total of two second sections 140*b* is provided while corresponding to both end sides of the knock-up late 120, and each of the second sections 140*b* has a length corresponding to a thickness of the rotating lever 150. The cross sectional shape of the second sections 140*b* is not limited as long as it increases the friction with respect to the lever rotating part 156.

A holder pad 132 may be provided at a lower side of the pickup roller 130. The printing medium S is provided to pass through in between the pickup roller 130 and the holder pad 132. The holder pad 132 is provided to allow the printing media S to pass in between the holder pad 132 and the pickup roller 130 one by one. The frictional force formed by the pickup roller 130 and the printing medium S is provided to be smaller than that formed between the holder pad 132 and the printing medium, so that the printing medium S is delivered only by the pickup roller 130 even when a plurality of sheets of printing media S are introduced.

The knock-up plate 120 may be provided on the feed tray 110. The knock-up plate 120 is provided on an upper side of the feed tray 110 so as to ascend and descend with respect to the feed tray 110 to press the printing medium stacked on the feed tray 110 toward the pickup roller 130. In detail, the knock-up plate 120 is provided on a downstream side in a feeding direction of the printing medium S on the feed tray 110, to raise the stacked printing medium to be pressed toward the pickup roller 130.

A plate elastic member 122 is provided between the feed tray 110 and the knock-up plate 120 to apply an elastic force such that the knock-up plate 120 ascends from the feed tray 110.

The knock-up plate 120 has a first state in which the knock-up plate comes into close contact with the feed tray 110 by descending and a second state in which the knock-up plate is spaced apart from the fed tray 110 by ascending.

The knock-up plate 120 includes a plate rotating part 120*a* and a plate lifting part 120*b*. The plate rotating part 120*a* is provided on an upstream side in a feeding direction of the printing medium S and allows the knock-up plate 120 to be rotated. The plate lifting part 120*b* is provided on a lower stream side in a feeding direction of the printing medium S and moves up and down. The first state and the second state correspond to descending and ascending of the plate lifting part 120*b*, respectively.

The knock-up plate 120 further includes a locking protrusion 124 that protrudes from the plate lifting part 120*b* so as to correspond to a holding protrusion 154 of the rotating lever 150 that will be described later.

The locking protrusion 124 is provided at an ascending end portion of the knock-up plate 120 on the downstream side in the delivery direction of the printing medium S so as to be restricted by the holding protrusion 154 of the rotating lever 150 which will be described later. As the locking protrusion 124 is pressed by the holding protrusion 154, the knock-up plate 120 is limited on the motion thereof such that the knock-up plate 120 comes into close contact with the feed tray 110.

The rotating lever 150 is configured to selectively restrict the knock plate 120.

The rotating lever 150 restricts the knock-up plate 120 such that the printing medium is loaded thereon, or allow the knock-up plate 120 to ascend during a pickup operation of the pickup roller 130.

The rotating lever 150 may be provided such that the knock-up plate 120 is restricted at a side of the feed tray 110 when the feed tray 110 rotates from the first position P1 to the second position P2. The allowing of the knock up plate 120 to be restricted at a side of the feed tray 110 using the rotating lever 150 may be achieved in various methods. In a first example, the knock-up plate 120 may be locked with the rotating lever 150 as the feed tray 110 is rotated from the first position P1 to the second position P2. In a second example, the knock plate 120 may be locked with the rotating lever 150 as the knock-up plate 120 is given a pressing force to come into close contact with the feed tray 100. However, the method of allowing the knock-up plate 120 to be restricted at a side of the feed tray 110 is not limited thereto.

The rotating lever 150 operates in linkage with the pickup roller 130 and the shaft 140 that operates together with the pickup roller 130. The restriction of the knock-up plate 120 is released by rotations of the pickup roller 130 and the shaft 140 according to a pickup operation of the pickup roller 130. In other words, the rotating lever 150 is spaced apart from the knock-up plate 120 upon a pick-up operation of the pickup roller 130, thereby releasing the restriction of the knock-up plate 120.

The rotating lever 150 may include a lever body 152 and the holding protrusion 154.

The lever body 152 is rotatably provided, and is kept pressed toward the knock-up plate 120 by a lever elastic member 170 which will be described later. The rotating lever 150 rotates in linkage with rotation of the pickup roller 130. The lever body 152 radially extends from a rotating center thereof, and is configured to come into close contact with the knock-up plate 120. The lever body 152 may be longitudinally provided in a shape extending from the shaft 140 toward the knock-up plate 120 so as to restrict or release an operation of the knock-up plate 120 in linage with operation of the shaft 140.

The lever elastic member 170 is configured to press the lever body 152 toward the knock-up plate 120. One end of the lever elastic member 170 presses the lever body 152, and the other end of the lever elastic member 170 is supported by a support frame 104 provided on the body 10. Although the support frame 104 according to an embodiment of the present disclosure is provided on the body 10, the present disclosure is not limited thereto. For example, the support frame 104 may extend from the feed tray 110. Although the lever elastic member 170 according to an embodiment of the present disclosure is fixed to a fixing part provided on the body 10, and includes a first elastic part 171 pressing the rotating lever 150 and a second elastic part 172 supported by the support frame 104, the shape of the lever elastic member 170 is not limited thereto.

If a force applied to the rotating lever 150 by the lever elastic member 170 is a first pressing force F1 and a force applied to the rotating lever 150 in linkage with rotation of the pickup roller 130 is a second pressing force F2, the second pressing force F2 is greater than the first pressing force F1 when the pickup roller 130 operates, so that the rotating lever 150 is spaced apart from the knock-up plate 1120.

The holding protrusion 154 protrudes from the lever body 152, and is configured to press the knock-up plate 120 toward the feed tray 110 such that the knock-up plate 120 is restricted from ascending.

The holding protrusion 154 may include a restriction surface 154*a*. The restriction surface 154*a* is a portion of the holding protrusion 154 making direct contact with the knock-up plate 120, and represents a surface that is bent from the lever body 152. The restriction surface 154*a* is provided to face an upper surface of the knock-up plate 120 to limit ascending of the knock-up plate 120.

The holding protrusion 154 may further include a guide inclination surface 154*b*. The guide inclination surface 154*a* is a surface that protrudes while being inclined with respect to a length direction extending from a rotating center of the lever body 152. That is, the guide inclination surface 154*a* is a surface that protrudes while being inclined with respect to a length direction extending from one end portion of the lever body 152 adjacent to the shaft 140 to the other end portion of the lever body 152 adjacent to an end of the knock-up plate 120. When the knock-up plate 120 changes from the first state in which the knock-up plate 120 is lifted from the feed tray 110 to the second state in which the knock-up plate 120 comes into close contact with the feed tray 110, the knock-up plate 120 may move along the lever body 152. The guide inclination surface 154*b* has an inclination to guide the end portion of the knock-up plate 120 such that the knock-up plate 120 is restricted by the restriction surface 154*a*.

The rotating lever 150 may further include the lever rotating part 156. The lever rotating part 156 may be provided such that the rotating lever 150 operates in linkage with rotations of the shaft 140 and the pickup roller 130. With regard to a pick up operation of the pickup roller 130, the lever rotating part 156 may move the lever body 152 to be spaced apart from the knock-up late 120. The movement of the lever body 152 may include at least one of a circular movement or a linear movement.

The lever rotating part 156 may be provided with a hollow part 158 allowing the shaft 140 to pass therethrough. In detail, the hollow part 158 may have an inner surface 157 having the hollow part 158. The rotating lever 150 is rotated by friction between the inner surface 157 and an outer surface of the shaft 140.

The lever rotating part 156 according to an embodiment of the present disclosure is provided in an elliptical shape to guide the lever rotating part 156 to perform a linear movement together with a circular movement around the shaft 140. However, according to another embodiment of the present disclosure, the lever rotating part 156 may be provided in a circular shape.

When the pickup roller 130 and the shaft 140 start rotating, the lever rotating part 156 receives a frictional force that is generated due to the rotation of the pickup roller 130 and the shaft 140 and enough to rotate in the same direction as that of the pickup roller 130 and the shaft 140. Since the lever body 152 is provided to move apart from the knock-up plate 120 according to rotation of the lever rotating part 156, even if the lever rotating part 156 is provided in a circular shape to surround the shaft 150, the lever body 152 moves apart from the knock-up plate 120. However, the hollow part 158, which has an elliptical shape (elliptical hollow part 158), not only provides a rotary force, but also allows the lever body 152 to linearly move apart from the knock-up plate 120 in a direction perpendicular to the lengthwise direction of the shaft 140, so that the rotating lever 150 is more clearly spaced from the knock-up plate 120.

The inner surface 157 may include an upper friction surface 157*a* and a lower friction surface 157*b*. The upper friction surface 157*a* and the lower friction surface 157*b* are provided to face each other while having a gap therebetween spaced enough to allow the shaft 140 to passed therethrough. That is, the gap may have a size larger than a diameter of the shaft 140.

In the first state, that is, when the knock-up plate 120 is caused to come into close contact with the feed tray 110 by the rotating lever 150, the shaft 140 makes contact with the lower friction surface 157*b* of the rotating lever 150 due to a force of the rotating lever 150 pushing the knock-up plate 120 toward the feed tray 110.

In the second state, that is, when the knock-up plate 120 is spaced apart from the feed tray 110, a force pushing the knock-up plate 120 toward the feed tray 110 does not act, so that the shaft 140 makes contact with the upper friction surface 157*a* of the rotating lever 150.

Accordingly, the lever rotating part 156, upon the second state of the knock-up plate 120, is subject to a weak rotation frictional force when compared to upon the first state of the knock-up plate 120, and in this state, the lever rotating part 156 is prevented from rotating beyond a predetermined angle due to the deadweights of the lever elastic member 170 and the rotating lever 150.

In addition, when the holding protrusion 154 of the rotating lever 150 is spaced apart from the locking protrusion 124 of the knock-up plate 120 according to rotation of the pickup roller 130, the rotating lever 150 performs a liner movement along the hollow part 158 of the lever rotating part 156 to prevent the knock-up plate 120 from being interfered by the rotating lever 150. That is, as the rotating lever 150 moves in direction A, the interference of knock-up plate 120 by the rotating lever 150 is more effectively prevented.

The rotating lever 150 may further include a depression part 161. The depression part 161 is formed on a lateral side of the lever body 152 extending in an elongated shape. In detail, the depression part 161 may be provided between the lever rotating part 156 and the holding protrusion 154.

When the knock-up plate 120 is spaced apart from the feed tray 110, the end portion of the knock-up plate 120 makes contact with the rotating lever 150 while being interfered with each other. In order to prevent such interference, the depression part 161 is formed by depressing a portion of the lever body 152 between the lever rotating part 156 and the holding protrusion 154. As the plate lifting part 120*b* is disposed on the depression part 161, the plate the knock-up plate 120 is prevented from being restricted by the holding protrusion 154 of the rotating lever 150 during operation of the pickup roller 130.

The rotating lever 150 may further include a mounting protrusion 162. The rotating lever 150 is pressed toward the knock-up plate 120 by the lever elastic member 170. The mounting protrusion 162 protrudes from the rotating lever 150 such that one end of the lever elastic member 170 mounts to the mounting protrusion 162.

The mounting protrusion 162 is provided at the opposite side of the holding protrusion 154 on the lever body 152. The mounting protrusion 162 protrudes from the lever body 152 while bent and extending in a direction opposite to the lever rotating part 156.

Hereinafter, an operation of the printing medium supplying apparatus 100 according to an embodiment of the present application and an image forming apparatus having the same will be described.

The feed tray 110 is provided on the body 10 so as to be rotated between the first position P1 in which the feed tray 110 is folded to one surface of the body 10 while forming an external appearance of the body 10 and the second position P2 in which the feed tray 110 is open such that the printing medium S is loaded on the feed tray 110.

Figure 6:
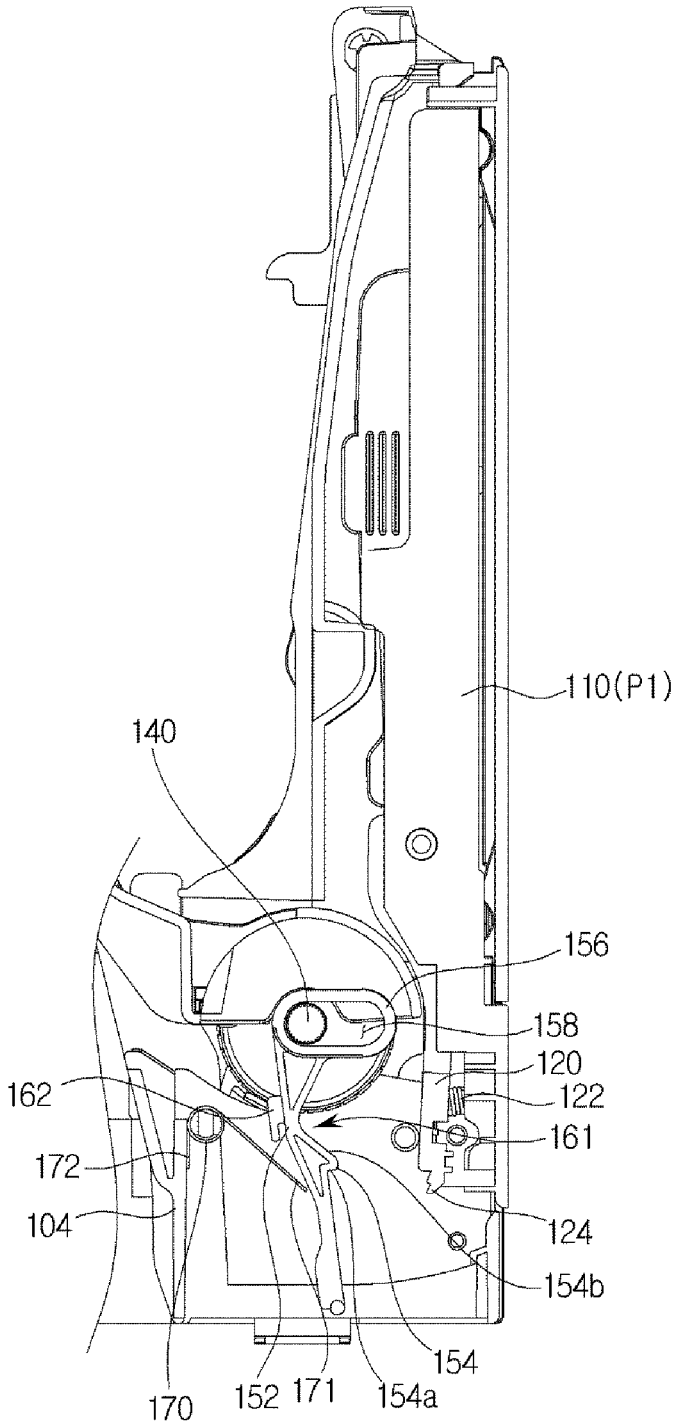
FIGS. 6, 7 and 8 are drawings illustrating an operation of an image forming apparatus according an embodiment of the present disclosure.

FIG. 6 illustrates an operation of the feed tray 110 in the first position P1 in which the knock-up plate 120 is caused to come into close contact with the supply tray 110 by the internal configuration of the body 10. In this state, the knock-up plate 120 is not directly restricted by the rotating lever 150, but when the feed tray 110 converts from the first position P1 to the second position P2, the knock-up plate 120 is restricted by the restriction surface 154*a* while moving along the lever body 152.

Figure 7:
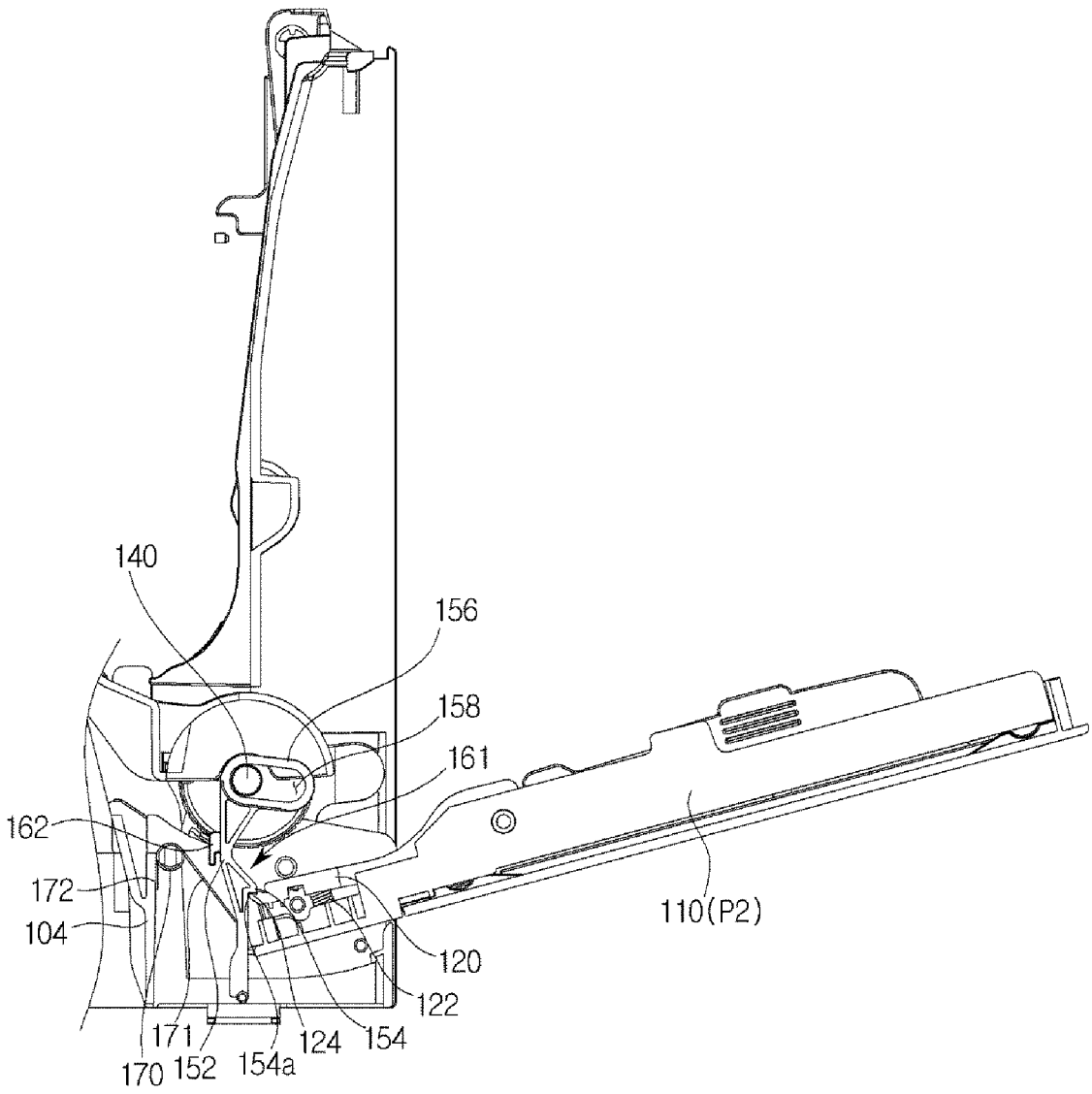

FIG. 7 illustrates an operation of the feed tray 110 converting from the first position P1 to the second position P2.

When the feed tray 110 is placed on the second position P2, the knock-up plate 120 is restricted by the holding protrusion 154 of the rotating lever 150 and thus comes into close contact with the feed tray 110. That is, the rotating lever 150 is pressed toward the knock-up plate 120 by the lever elastic member 170, and in this case, the holding protrusion 154 of the rotating lever 140 restricts the locking protrusion 124 of the knock-up plate 120, thereby allowing the knock-up plate 120 to come into close contact with the feed tray 110.

According to the present embodiment, the knock-up plate 120 is restricted by the rotating lever 150 while the feed tray 110 is being converted from the first position P1 to the second position P2. However, according to another embodiment, the knock-up plate 120 may be restricted as the knock-up plate 120 is directly pressed toward the feed tray 110 when the feed tray 110 is placed in the second position P2.

Figure 8:
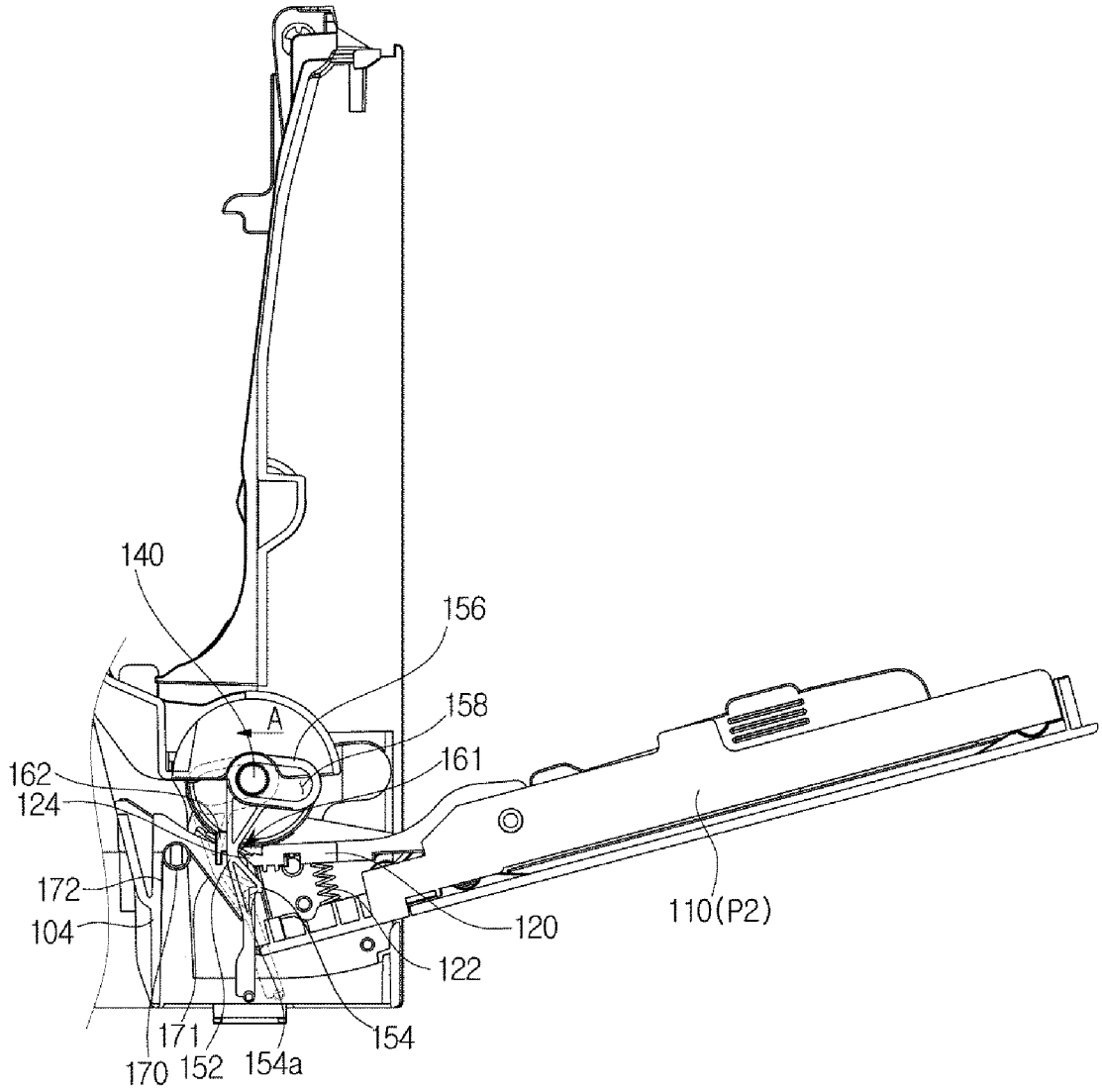

FIG. 8 illustrates the pickup roller 130 that operates such that the printing medium is supplied.

When the pickup roller 130 operates, the lever rotating part 156 receives a frictional force according to rotation of the shaft 140. The lever rotating part 156 performs a circular movement according to rotation of the shaft 140, or performs a linear movement at the hollow part 158 as the restriction on the holding protrusion 154 by the locking protrusion 124 is released.

In this process, the rotating lever 150 is spaced apart from the knock-up plate 120, and the knock-up plate 120 is raised by the plate elastic member 122 provided between the knock-up plate 120 and the feed tray 110, so that the printing medium is pressed toward the pickup roller 130.

According to an embodiment of the present application, the knock-up plate 120 is applied to the feed tray 110, so that the printing medium is easily pressed toward the pickup roller 130, and there is no need of an operation of additionally pressing the knock-up plate 120 or keeping the knock-up plate 120 pressed in order to supply the printing medium to the feed tray 110. In addition, the knock-up plate 120 operates in linkage with operation of the feed tray 110, thereby providing user's convenience. In addition, the restriction of the knock-up plate 120 is released according to an operation of the pickup roller 130, thereby enhancing the efficiency in supplying the printing medium.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a body;

a feed tray configured to rotate between a first position in which the feed tray forms an external appearance of the body and a second position in which a printing medium is loaded;

a knock-up plate provided on the feed tray configured to ascend and descend;

a pickup roller configured to pick up the loaded printing medium; and a rotating lever including a holding protrusion to restrict ascending of the knock-up plate when the feed tray rotates from the first position to the second position.

2. The image forming apparatus of claim 1, wherein the pickup roller is coupled to a shaft, and wherein the rotating lever releases the restriction of the knock-up plate by rotation of the pickup roller and the shaft at the same time when the pickup roller picks up the printing medium.

3. The image forming apparatus of claim 1, wherein the rotating lever includes a lever body and the holding protrusion includes a restriction surface that is bent from the lever body to make contact with the knock-up plate to restrict an ascending side of the knock-up plate.

4. The image forming apparatus of claim 3, wherein the holding protrusion includes a guide inclination surface that protrudes so as to be inclined with respect to a length direction extending from a rotating center of the lever body such that the knock-up plate is restricted by the restriction surface.

5. The image forming apparatus of claim 1, wherein the knock-up plate is provided on a downstream side in a feeding direction of the printing medium on the feed tray.

6. The image forming apparatus of claim 1, wherein the knock-up plate includes:

a plate rotating part provided on an upstream side in a feeding direction of the printing medium and allowing the knock-up plate to be rotated; and a plate lifting part provided on a downstream side in a feeding direction of the printing medium and configured to ascend and descend.

7. The image forming apparatus of claim 6, wherein the knock-up plate further includes a locking protrusion that protrudes from the plate lifting part so as to be restricted by the rotating lever.

8. The image forming apparatus of claim 1, wherein:

the rotating lever includes a lever body; and the image forming apparatus further comprises a lever elastic member configured to press the lever body toward the knock-up plate.

9. The image forming apparatus of claim 8, wherein the rotating lever further includes a mounting protrusion to mount one end of the lever elastic member pressing the lever body thereon.

10. The image forming apparatus of claim 1, wherein:

the rotating lever includes a lever body; and the rotating lever further comprises a lever rotating part provided at an end portion of the lever body to rotate the lever body and configured to operate with rotation of the pickup roller.

11. The image forming apparatus of claim 10, further comprising:

a shaft coupled to the pickup roller, wherein the lever rotating part is provided with an elliptical hollow part allowing the shaft to pass therethrough.

12. The image forming apparatus of claim 11, wherein:

the lever rotating part includes an inner surface forming the elliptical hollow part, and the rotating lever is rotated by friction made between the inner surface of the lever rotating part and an outer surface of the shaft.

13. The image forming apparatus of claim 12, wherein the elliptical hollow part is provided in an elliptical shape such that the rotating lever moves in a direction perpendicular to a lengthwise direction of the shaft.

14. The image forming apparatus of claim 11, wherein the shaft includes:

a first section to which the pickup roller is coupled and which is passed by the printing medium; and second sections which are provided at both sides of the first section and on which the rotating lever is disposed.

15. The image forming apparatus of claim 14, wherein the second sections are provided with a plurality of protrusions formed along a circumference of the shaft to increase friction with the inner surface of the lever rotating part.

16. A printing medium supplying apparatus comprising:

a feed tray on which a printing medium is loaded;

a pickup roller configured to pick up the loaded printing medium;

a knock-up plate provided on the feed tray so as to ascend and descend to allow the printing medium to make contact with the pickup roller; and a rotating lever configured to allow the knock-up plate to be restricted at a side of the feed tray, the rotating lever configured to release the restriction of the knock plate by being spaced apart from the knock-up plate when the pickup roller picks up the printing medium.

17. The printing medium supplying apparatus of claim 16, wherein the rotating lever includes:

a lever body provided in an elongated shape;

a lever rotating part provided at an end portion of the lever body and configured to operate with rotation of the pickup roller such that the lever body is moved; and a holding protrusion which protrudes from the lever body to press the knock-up plate toward the feed tray.

18. The printing medium supplying apparatus of claim 16, further comprising a lever elastic member configured to press the rotating lever toward the knock-up plate.

19. The printing medium supplying apparatus of claim 18, wherein if a force applied to the rotating lever by the lever elastic member is a first pressing force F1 and a force applied to the rotating lever in linkage with rotation of the pickup roller is a second pressing force F2, and the second pressing force F2 is greater than the first pressing force F1 when the pickup roller operates.

20. The printing medium supplying apparatus of claim 16, wherein:

the knock-up plate includes a first state in which the knock plate descends to make contact with the feed tray, and a second state in which the knock-up plate ascends to be spaced apart from the feed tray, and the knock-up plate operates from the first state to the second as the rotating lever is spaced apart from the knock-up plate due to rotation of the pickup roller.

* * * * *